US010603541B2

(12) United States Patent
Chizhov et al.

(10) Patent No.: US 10,603,541 B2
(45) Date of Patent: Mar. 31, 2020

(54) SIMULATOR SYSTEM AND METHOD FOR EXERCISING LOWER LIMBS OF A USER SEATED ON A WHEELCHAIR OR LIKE VEHICULAR SYSTEM

(71) Applicant: RehabMaker Corporation, Ekaterinburg (RU)

(72) Inventors: Nikita Igorevich Chizhov, Ekaterinburg (RU); Anastasia Galkina, Ekaterinburg (RU)

(73) Assignee: RehabMaker Corporation, Houston, TX (US)

( * ) Notice: Subject to any disclaimer, the term of this patent is extended or adjusted under 35 U.S.C. 154(b) by 45 days.

(21) Appl. No.: 16/000,080

(22) Filed: Jun. 5, 2018

(65) Prior Publication Data

US 2019/0168069 A1 Jun. 6, 2019

Related U.S. Application Data

(60) Provisional application No. 62/593,272, filed on Dec. 1, 2017.

(51) Int. Cl.

| | |
|---|---|
| ***A63B 23/04*** | (2006.01) |
| ***A61G 5/10*** | (2006.01) |
| ***A61G 5/12*** | (2006.01) |
| ***A63B 22/06*** | (2006.01) |
| ***A63B 23/035*** | (2006.01) |

(52) U.S. Cl.

CPC ..... *A63B 23/04* (2013.01); *A61G 5/10* (2013.01); *A61G 5/128* (2016.11); *A63B 22/0605* (2013.01); *A63B 23/03516* (2013.01); *A63B 2208/0233* (2013.01)

(58) Field of Classification Search

CPC ..... A63B 23/04; A63B 22/0605; A63B 2208/0233; A63B 23/03516; A61G 5/10; A61G 5/128

See application file for complete search history.

(56) References Cited

U.S. PATENT DOCUMENTS 4,402,502 A * 9/1983 Peters ..... A61H 1/0214 482/139
4,587,960 A * 5/1986 Schotten ..... A61H 1/0214 482/57
4,824,132 A * 4/1989 Moore ..... A61G 5/023 280/250.1

(Continued)

*Primary Examiner* — Garrett K Atkinson

(57) ABSTRACT

The present invention discloses a simulator system and method for exercising the limbs of a user confined to the wheelchairs. The method of rehabilitation of the user includes providing a simulator system mountable on the wheelchair, configuring various parameters associated with a gear motor, and a pair of pedals using a user interface device, configuring the pedals in a specific direction and position, initiating exercise by using the user interface device, monitoring a set of information related to pedaling during or after the exercise on the user interface device, receiving the parameters associated with the gear motor, the pair of pedals from the user interface device, and sensors, analyzing the parameters received from the sensors and the user interface device, and generating corrective commands based on the analysis of the received parameters.

20 Claims, 9 Drawing Sheets

(56) References Cited

U.S. PATENT DOCUMENTS 5,284,131 A * 2/1994 Gray ..... A61H 1/0214 482/57
5,330,402 A * 7/1994 Johnson ..... A63B 22/0012 482/52
5,951,442 A * 9/1999 Adams ..... A61H 1/0214 482/57
6,092,822 A * 7/2000 Salmon ..... A61G 5/023 280/250.1
6,142,914 A * 11/2000 Crawford ..... A61H 1/0214 280/304.1
6,447,428 B1 * 9/2002 McKillip ..... A61H 1/0214 482/57
6,607,470 B2 * 8/2003 Catanescu ..... A63B 22/0694 482/57
6,755,768 B1 * 6/2004 Garcia-Rill ..... A61H 1/0214 482/51
6,960,155 B2 * 11/2005 Chien ..... A61H 1/0214 482/62
9,387,139 B2 * 7/2016 Chang ..... A61G 5/023
10,188,929 B2 * 1/2019 Kabes ..... A63B 71/0009
2003/0092535 A1 * 5/2003 Catanescu ..... A63B 22/0694 482/60
2004/0121885 A1 * 6/2004 Garcia-Rill ..... A61H 1/0214 482/60
2004/0259693 A1 * 12/2004 Chien ..... A61H 1/0214 482/62
2006/0096792 A1 * 5/2006 Usherovich ..... A61G 5/045 180/11
2006/0247095 A1 * 11/2006 Rummerfield ..... A61H 1/0214 482/1
2008/0246246 A1 * 10/2008 Dix ..... A61G 5/023 280/233
2009/0088300 A1 * 4/2009 Catanescu ..... A61H 1/0214 482/51
2013/0303340 A1 * 11/2013 Polishuk ..... A63B 22/04 482/80
2015/0329164 A1 * 11/2015 de Winter ..... B62K 5/05 280/259
2016/0058636 A1 * 3/2016 Chang ..... A61G 5/023 280/230
2017/0224571 A1 * 8/2017 Pisano ..... A61H 1/001
2018/0057096 A1 * 3/2018 Ryan ..... B62M 6/60

* cited by examiner

SIMULATOR SYSTEM AND METHOD FOR EXERCISING LOWER LIMBS OF A USER SEATED ON A WHEELCHAIR OR LIKE VEHICULAR SYSTEM

CROSS REFERENCE TO RELATED APPLICATION

The present application claims the priority benefits of U.S. Provisional Application No. 62/593,272, filed on Dec. 1, 2017, titled "ATTACHABLE SIMULATOR FOR USER VEHICULAR SYSTEM", which is incorporated herein by reference in its entirety.

FIELD OF INVENTION

The present invention relates generally to exercising devices. More particularly, the present invention pertains to a simulator system removably mountable on conventional wheelchairs, or like vehicular systems, and a method of rehabilitation using the simulator system, in order to enable disabled users confined to the wheelchairs to exercise their lower limbs.

BACKGROUND OF INVENTION

Conventional wheelchairs, strollers or like vehicular systems has given people the ability to move around independently without the aid of others. We often see elderly and handicapped people commonly use manual and electrical wheelchairs to move around. Presently, these wheelchairs are only used for sitting and transportation without having any means of medical rehabilitation for maintaining and improving a user's health condition through physical exercise.

Millions of people worldwide suffer from weakness of lower limbs, also commonly known as "Paraplegia", usually caused by stroke or spinal cord injury. Some people are paraplegic by birth. It is found that paraplegia takes a bigger toll in people who used to routinely exercise and then suddenly stopped exercising, in other words paraplegia is more common in people who are forced to be on the wheelchair due to some unfortunate events such as an accident or a stroke. Simulation of muscle impulses to drive blood flow in their limbs is the main problem of such disabled people.

In order to address this problem, a number of exercise machines have been proposed in the past to enable the disabled users to exercise. For example, U.S. Pat. No. 3,410,553 issued to Safford discloses a structure for rehabilitation of individuals suffering from paraplegia. The apparatus as disclosed in the patent comprises a base with four legs terminating in a circular girt for supporting the patient during rehabilitation. The disadvantage of this proposed device is that the user is required to enter and exit the proposed structure in order to exercise.

Some inventors proposed different other exercising devices, such as ergonomic stationary bicycles often used for medical exercises. Such bicycles include a braking system and a device indicating the effort made during exercise. Normally, a person is required to sit on the bicycle saddle holding on to a handle bar and exercises his/her limbs using two pedals. Such bicycles are preferably suitable to people who can move without any assisting devices and who can sit on the bicycle saddle.

Those people who cannot stand on their own or sit on the bicycle saddle, such as the majority of disabled people or people with acute paraplegia, are unable to use such exercising devices.

There have been many other exercise devices proposed for attachment to the wheelchairs to enable exercising by the user of the wheelchair. For example, U.S. Pat. Nos. 4,824,132, 2,630,332, 4,572,501. Such prior art devices are devised to enable the users of the wheelchairs to exercise are difficult and time consuming to attach to the wheelchair. Those devices require considerable manual effort to both attach and remove the device from the frame of the wheelchairs.

Further, we have seen lots of disabled people undergo special exercise programs and physiotherapy in various hospitals or rehabilitation centers. Such treatments at many times prove to be costly and time consuming as one has to take on number of treatment sessions and such treatments can last for months with no improvements.

Thus, in the light of above mentioned background, it is desired to have a comfortable to use exercising device for the disabled people, especially for the people with paraplegia or like problem. The proposed invention provides a simulator system and method for exercising the limbs of users who are confined to the wheelchairs, the strollers or the like vehicular systems. The proposed invention provides a simulator system removably mountable on the conventional wheelchairs, or the like vehicular systems in order to enable the user confined to the wheelchair, or the like vehicular system to exercise.

SUMMARY

It is an object of the present invention is to provide a simulator system and method for exercising the limbs of a user confined to the wheelchairs, the strollers or the like vehicular systems.

Another objective of the present invention is to provide a simulator system removably mountable on the conventional wheelchairs, the strollers or the like vehicular systems.

Another objective of the present invention is to provide an autonomous simulator system removably mountable on the conventional vehicular systems in order to enables the disabled users to take on active or passive training both indoors or outdoors.

It is another object of the present invention to provide an easy to use exercising device for home exercise, especially for the users who require the wheelchair or the like vehicular system for mobility.

Another object of the present invention is to provide an exercise device or simulator that is portable and thus can be easily moved from one location to another.

Another object of the present invention is to provide an exercising device which is readily and quickly attachable to the wheelchairs or the like vehicular systems and which is easily removable therefrom.

Another object of the present invention is to provide a simulator useful for patients suffering from cerebral palsy, paraplegia, tetraplegia, stroke, etc. to restore the motor function in the patient's limbs.

According to an aspect of the present invention, there is provided a simulator system removably mountable on a wheelchair for exercising lower limbs of a user seated thereon. The simulator system comprising a housing comprising an electrical motor with a first shaft having a first end and a second end, wherein the first end and the second end of the first shaft horizontally extending out of the housing through a pair of lateral faces.

According to the same aspect, the simulator system includes a support assembly comprising a pair of supporting members, each of the supporting members comprising a first arm with a first slot, and a second arm with a second slot, wherein the first arm and the second arm are conjoint at a junction embodying a third slot; a first connecting arm comprising a first end and a second end, wherein the first end and the second end of the first connecting arm engages into the third slot present in each of the pair of supporting members; a second connecting arm comprising a first end and a second end, wherein the first end and the second end of the second connecting arm engages into the second slot present in each of the pair of supporting members; an elongated arm with a proximal end and a distal end, the elongated arm engages to the first connecting arm at the distal end, and is adapted to support and slidably move the housing mounted thereon along its longitudinal axis using a first rotating knob present near the proximal end; a second rotating knob mounted on a second shaft connecting the second connecting arm and a bracket engaged to the first connecting arm, wherein the second rotating knob helps adjust a tilt angle of the housing attached over the elongated arm, and provide stability to the support assembly, when the simulator system is mounted on the wheelchair; and a pair of connecting members, each of the connecting members comprising a gripping assembly, and a vertical shaft mounted on the gripping assembly, wherein the vertical shaft of each of the pair of connecting members engages into the first slot present in each of the pair of supporting members, and the gripping assembly of each of the pair of connecting members engages to a base frame of the wheelchair for removably mounting the simulator system on the wheelchair.

According to the same aspect, the simulator system includes a pair of pedals, each of the pedals connected to the first end and the second end of the first shaft horizontally extending out of the housing through the pair of lateral faces.

According to the same aspect, the simulator system further includes an electric drive unit configured to drive the electrical motor, thereby enabling the pair of pedals engaged to the first shaft to rotate in a specified direction.

According to the same aspect, the simulator system further includes one or more user interface devices to enable the user seated on the wheelchair to at least view one or more parameters associated with the electrical motor, and the pair of pedals, and change the one or more parameters associated with the electrical motor, and the pair of pedals.

According to the same aspect, the simulator system further includes one or more brakes enabling the user to lock the pair of pedals in a specific direction and position, and one or more handles configurable in an area in front of arm rests provided on the wheelchair, wherein the one or more handles are adapted to hold the one or more user interface devices According to another aspect of the present invention, there is provided a method for exercising lower limbs of a user seated on a wheelchair. The method comprising the steps of providing, a simulator system mountable on the wheelchair, configuring the one or more parameters associated with the gear motor, and the pair of pedals using the one or more user interface devices; configuring, the pair of pedals in a specific direction and position so as to allow the user seated on the wheelchair to comfortably place the limbs on the pair of pedals, wherein the step of configuring the pair of pedals in a specific direction and position is facilitated by adjusting a tilt angle and position of the housing mounted over the elongated arm of the support assembly; and initiating, exercise by using the one or more user interface devices; monitoring, a set of information related to pedaling during or after the exercise, on the one or more user interface devices.

According to the same aspect, the method further comprises a step of providing a control unit embodied within the electric drive unit, and operationally coupled to the one or more user interface devices, the gear motor, one more sensors, wherein the control unit performing at least one of: receiving the one or more parameters associated with the gear motor, the pair of pedals from the one or more user interface devices, and the one or more sensors, analyzing the one or more parameters received from the one or more sensors and the one or more user interface devices; and generating, one or more corrective commands based on the analysis of the one or more parameters received from the one more sensors, and the one or more user interface devices.

Various objects, features, aspects and advantages of the present invention will become more apparent from the following detailed description of the embodiments of the invention, along with the accompanying drawings.

BRIEF DESCRIPTION OF THE DRAWINGS

The foregoing summary, as well as the following detailed description of preferred embodiments, is better understood when read in conjunction with the appended drawings. There is shown in the drawings example embodiments, however, the application is not limited to the specific system and method disclosed in the drawings.

DETAILED DESCRIPTION

Embodiments of the present disclosure will be described more fully hereinafter with reference to the accompanying drawings in which like numerals represent like elements throughout the several figures, and in which example embodiments are shown. Embodiments of the claims may, however, be embodied in many different forms and should not be construed as limited to the embodiments set forth herein. The examples set forth herein are non-limiting examples and are merely examples among other possible examples.

In relation to describing the present disclosure in the light of accompanying drawings, the words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items.

It must also be noted that as used herein and in the appended claims, the singular forms "a," "an," and "the" include plural references unless the context clearly dictates otherwise. Although any systems and methods similar or equivalent to those described herein can be used in the practice or testing of embodiments of the present disclosure, the preferred, systems and methods are now described. In the context of present invention, terms such as "disabled users,", "patients,", "elderly people,", "handicapped people," and so on are all interchangeably used. It should be understood that all of these terms basically relates to a user having problem with their limbs, problem of nature which doesn't allow the person to stand with the aid of other users or other supports. Particularly, the intended users of the proposed simulator system are patients suffering from cerebral palsy, paraplegia, tetraplegia, stroke, etc. and who are recommended to exercise in order to be able to restore the motor function in their limbs.

Various features and embodiments of the simulator system and method of rehabilitation for the disabled users confined to the wheelchairs are explained in conjunction with the description of FIGS. 1-10.

Figure 1:
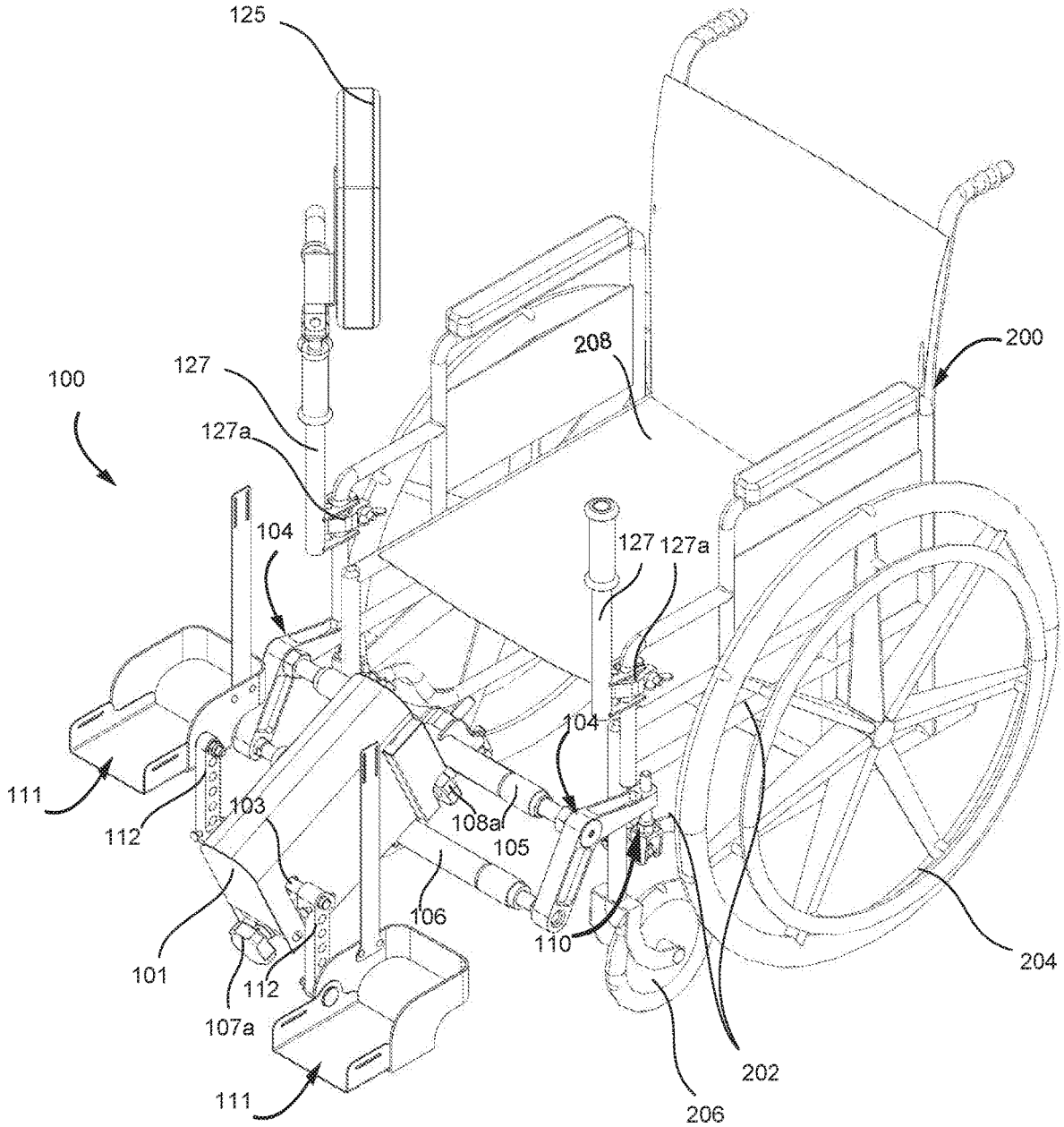
FIG. 1 illustrates a simulator system of the present invention mounted on a wheelchair, in accordance with various embodiments.
Figure 2:
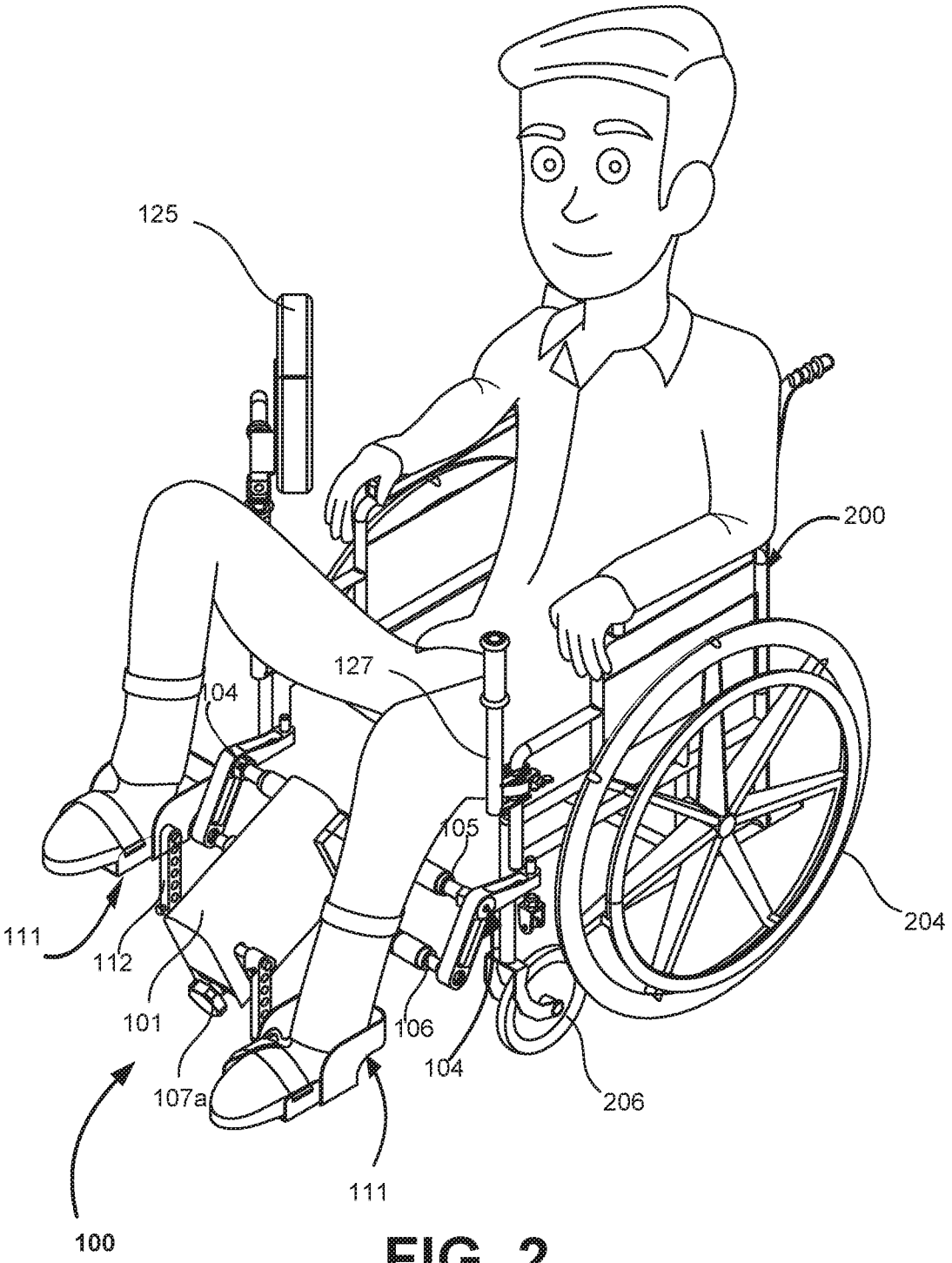
FIG. 2 illustrates the simulator system mounted on the wheelchair, and being used by a user seated on the wheelchair, in accordance with various embodiments.

Referring to FIGS. 1-2, a simulator system 100 of the present invention is shown mounted on a wheelchair 200, and being used by a user 102 seated on the wheelchair 200, in accordance with various embodiments. The wheelchair 200 in the context of present invention may include any conventional wheelchairs, strollers, or like vehicular systems that assists patients, elderly people or disabled people to move around independently without the aid of others. The wheelchair 200 may be a manually operated wheelchair or may be an electrically operated wheelchair. The implementation of the present invention is not limited to the type of vehicular system on which the presented simulator system 100 is mounted to facilitate the patients, or disabled users to exercise their lower limbs for rehabilitation purpose. The exercising of the lower limbs is essential for the patients suffering from cerebral palsy, paraplegia, tetraplegia, stroke, and the like to restore the motor function in their limbs.

As seen in the FIG. 1, the wheelchair 200 consists of a base frame 202 comprising one or more rods welded or conjoint together to form the base frame 202. Usually, to the base frame 202, a seat with a back rest 208, and a plurality of wheels 204, 206 are attached. The wheels at one end of the base frame 202 are caster wheels 206 capable of rotating 360 degrees and wheels fixed to the other end of the base frame 202 are drive wheels 204 which are independently rotatable by hand by the user to move the wheelchair 200. Although, such wheelchairs 200 conventionally known in the art facilitates the user with mobility, such conventional wheelchairs 200 doesn't have any means of medical rehabilitation for maintaining and improving a user's health condition through physical exercise especially for the patients or the disabled users suffering from cerebral palsy, paraplegia, tetraplegia, stroke, and the like, that requires restoration of the motor function in their limbs. The proposed invention intends to fill out this gap by providing the simulator system 100 and associated method of rehabilitation using the simulator 100 that would essentially enable the patients or the disabled users confined to the wheelchairs 200 to exercise their lower limbs to improve the motor functions in their limbs.

As shown in FIGS. 1-8, the simulator system 100 is removably mountable on the wheelchair 200 for exercising lower limbs of the user seated on the wheelchair 200.

According to various embodiments, the simulator system 100 includes a housing 101. The housing 101 embodies an electrical motor 102 with a first shaft 103 having two ends, namely a first end and a second end. The first end and the second end of the first shaft 103 horizontally extends out of the housing 101 through a pair of lateral faces 101*a* (only one lateral face is visible). According to an example, the electrical motor 102 is a gear motor. As known, the gear motor includes integrated series of gears or a gear box being attached to the main motor rotor in order to generate high torque while maintaining a low horsepower, or low speed, motor output.

The simulator system 100 further includes a support assembly. The support assembly includes a pair of supporting members 104. Each of the supporting members 104 includes a first arm 104*a* with a first slot, and a second arm 104*b* with a second slot. The first arm 104*a* and the second arm 104*b* of each of the supporting members 104 are conjoint at a junction embodying a third slot. Further, according to the embodiment of the invention, the pair of supporting members 104 is configured parallel to each other.

The support assembly further includes a first connecting arm 105. The connecting arm 105 includes two ends, a first end and a second end. The connecting arm 105 engages into the third slot present in each of the pair of supporting members 104 via its first end and the second end. As seen in the FIGS. 3 and 4, the first connecting arm 105 is engaged to the pair of supporting members 104 by means of a pair of nuts 105*a*. Further, the connecting arm 105 engages into the third slot present in each of the pair of supporting members 104 using one or more washers 105*b*, and one or more sleeves (not seen). The pair of nuts 105*a* helps the simulator system 100 to be mounted or assembled on the wheelchair 200 of varied width. For example, during installation, the installer can loosen the nuts 105*a* to create an extra space allowing the simulator 100 to mount on the wheelchair 200 that varies in its width.

The support assembly further includes a second connecting arm 106 with a first end and a second end. The second connecting arm 106 engages into the second slot present in each of the pair of supporting members 104 via the first end and the second end. According to the embodiment, the first connecting arm 105 and the second connecting arm 106 engaging the pair of supporting members 104 are configured parallelly at a suitable distance from each other.

The support assembly further includes an elongated arm 107 with a proximal end and a distal end. The elongated arm 107 engages to the first connecting arm 105 at the distal end. The elongated arm 107 supports the housing 101 mounted thereon. The elongated arm 107 facilitates slidable movement/motion of the housing 101 along its longitudinal axis or length using a first rotating knob 107*a* present near the proximal end. The rotating knob 107*a* is specifically mounted at an end of a shaft 107*b*. The shaft 107*b* embodies a spring (not seen) and is housed within the elongated arm 107.

The support assembly further includes a second rotating knob 108*a* mounted on a second shaft 108. The shaft 108 connects the second connecting arm 106 and a bracket 109. The bracket 109 engaged to the first connecting arm 105. The second rotating knob 108*a* can be slidably rotated to adjust a tilt angle or slope of the housing 101 attached over the elongated arm 107. The adjustment of the rotating knob 108*a* also provides stability to the support assembly, when the simulator system 100 is mounted on the wheelchair 200.

Figure 4:
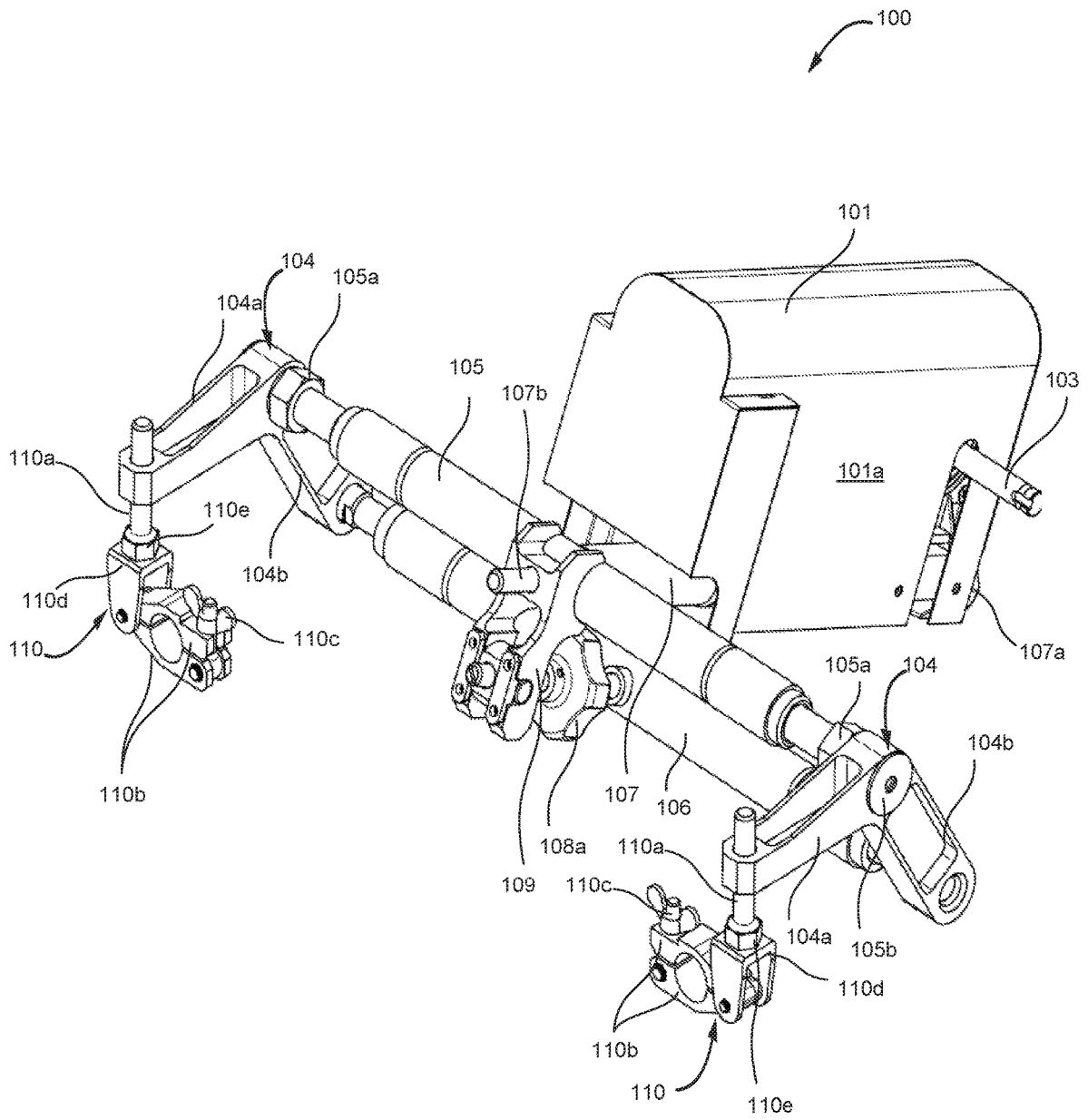
FIG. 4 illustrates a back perspective view of the simulator system of FIG. 1 with some of the components removed, in accordance with various embodiments.
Figure 5:
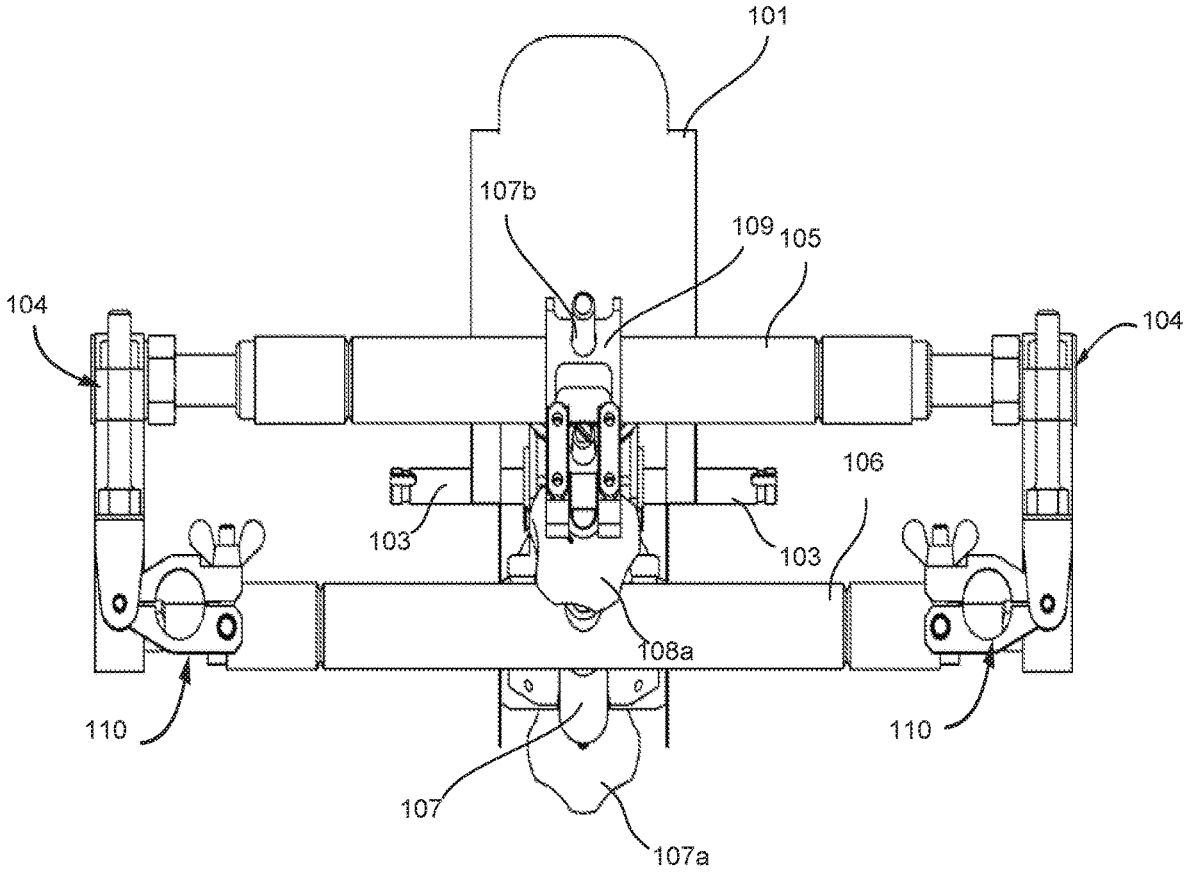
FIG. 5 illustrates a back view of the simulator system of FIG. 4, in accordance with various embodiments.
Figure 6:
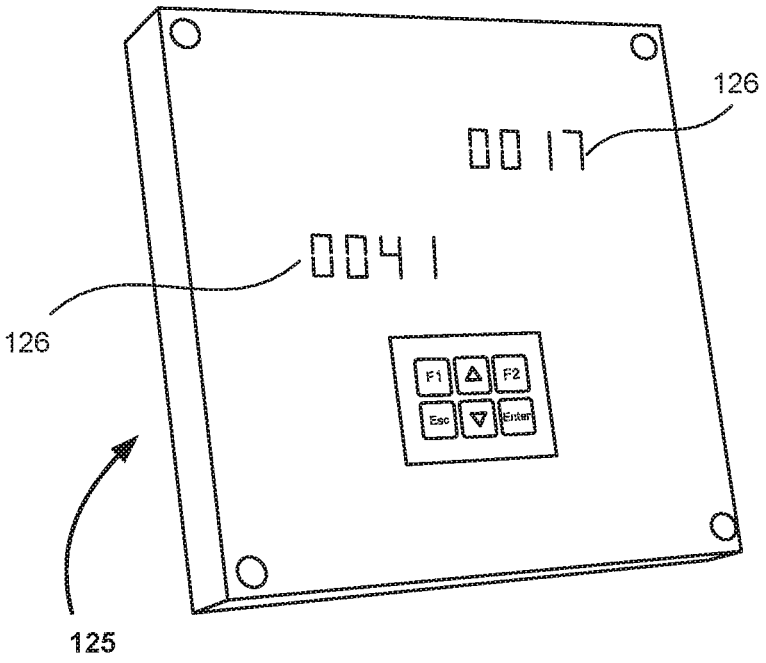
FIG. 6 illustrates front view of a user interface device operative by the user seated on the wheelchair, according to various embodiments.
Figure 7:
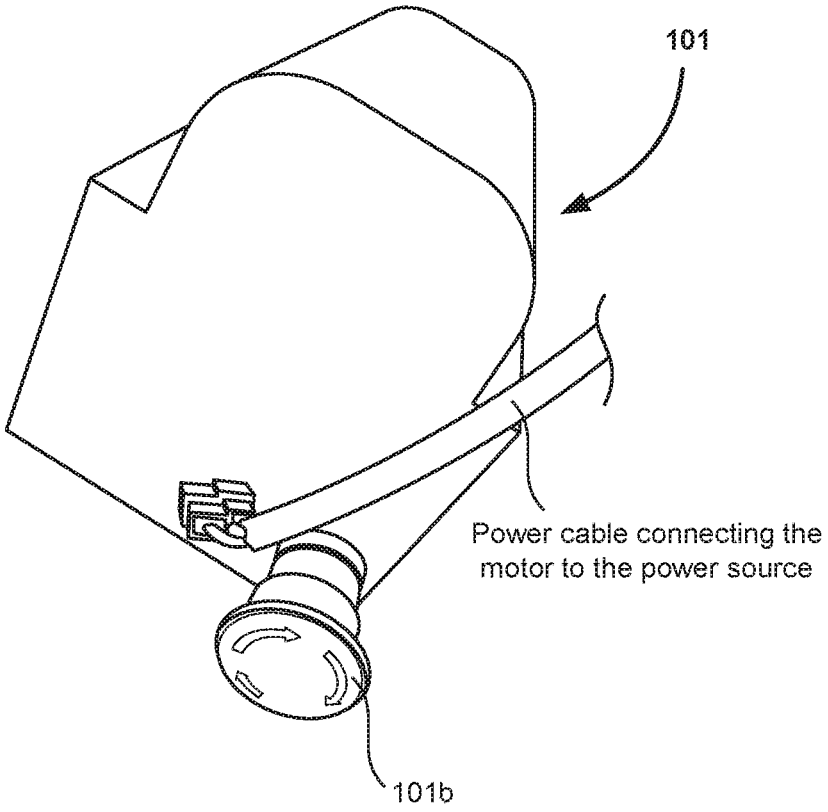
FIG. 7 illustrates power connectivity to the housing embodying the electrical motor, and an emergency brake, according to various embodiments.

The support assembly further includes a pair of connecting members 110. Each of the connecting members 110 includes a gripping assembly 110*b*-110*d*, and a vertical shaft 110*a* mounted on the gripping assembly 110*b*-110*d*. As best seen in FIG. 4, the gripping assembly comprises of a pair of gripping jaws 110*b* (an upper jaw 110*b* and a lower jaw 110*b*) pivotally mounted within a bracket 110*d*. The pair of gripping jaws 110*b* is secured together by a pin 110*c* or like means that can keep the two jaws together. The vertical shaft 110*a* of each of the pair of connecting members 110 engages into the first slot present in each of the pair of supporting members 104. The gripping assembly 110*b*-110*d* of each of the pair of connecting members 110 engages to the base frame 202 of the wheelchair 200 on two sides in order to facilitate mounting of the simulator system 100 on the wheelchair 200 as shown in the FIGS. 1-2.

Figure 3:
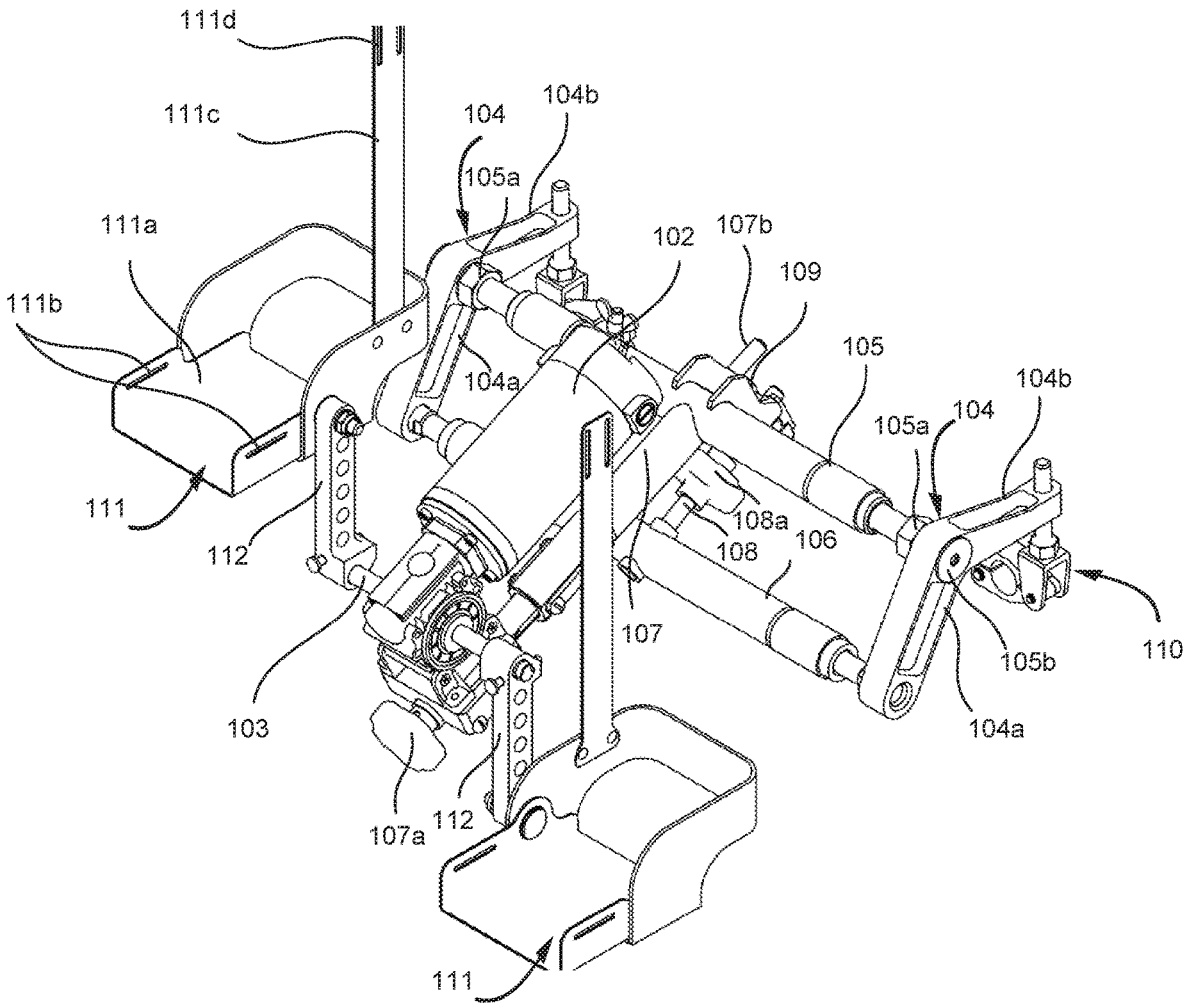
FIG. 3 illustrates a front perspective view of the simulator system of FIG. 1 with some of the components removed, in accordance with various embodiments.
Figure 9:
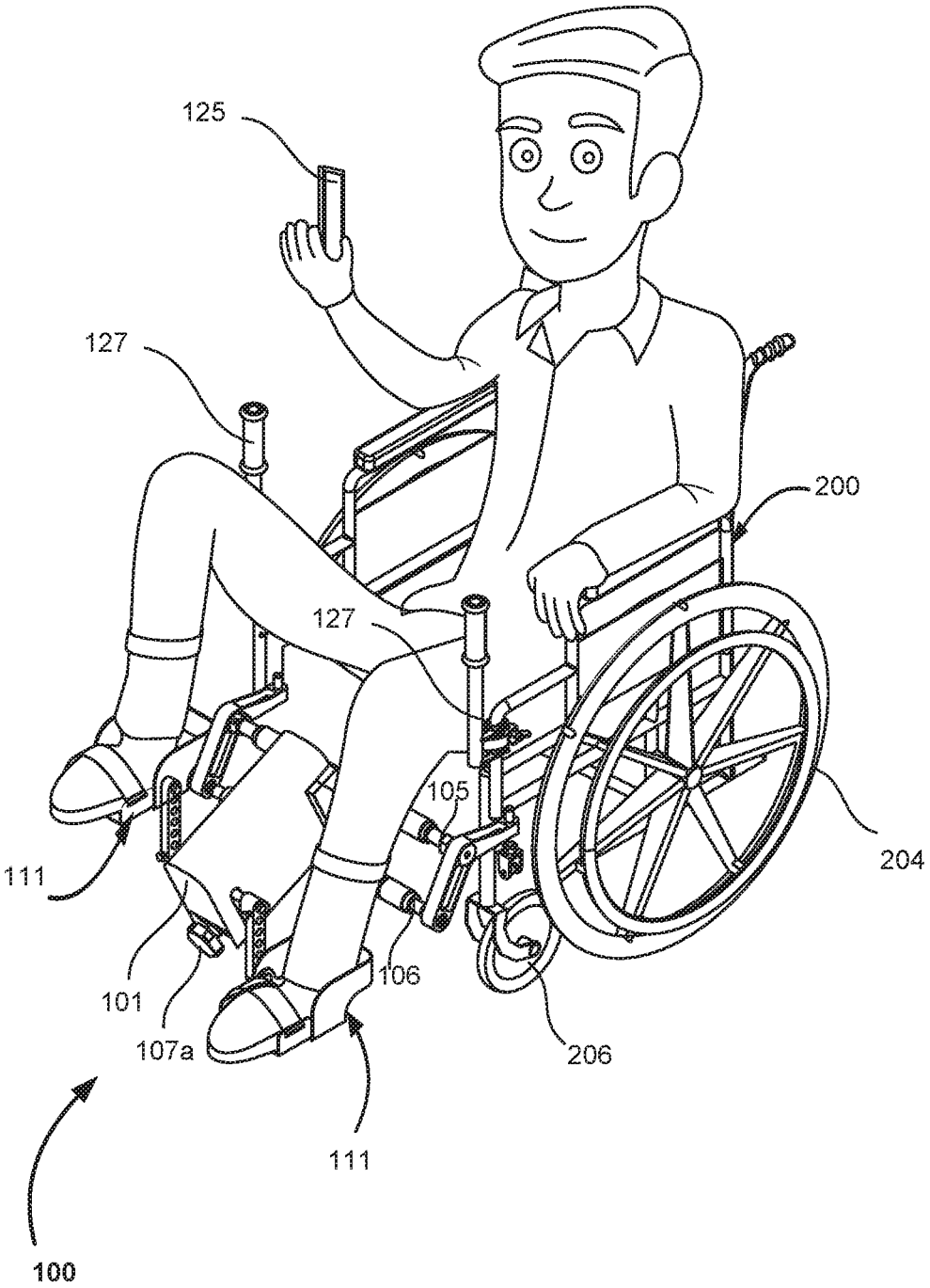
FIG. 9 illustrates an alternative embodiment showing the simulator system in use by the user seated on the wheelchair.

According to various embodiments, the simulator system 100 further includes a pair of pedals 111 as shown in the FIGS. 1 and 3. The pedals 111 may also have straps to secure the pedals 111 onto the limbs of the user seated on the wheelchair 200 as shown in FIGS. 2 and 9. Each of the pedals 111 include a foot rest area 111*a* with slits 111*b*, a side arm 111*c* with slits 111*d* to embody straps 111*e* as shown in the FIGS. 2 and 3. Each of the pedals 111 is connected to the first end and the second end of the first shaft 103 respectively. According to the embodiment, each of the pedals 111 is connected to the first end and the second end of the shaft 103 by means of a height adjustment member 112.

As shown in the FIGS. 1 and 3, the height adjustment member 112 includes a plurality of slots. These plurality of slots helps in height adjustment of the pedals 111 with respect to the housing 101. The pedals 111 may be fitted into the lower slot or top most slot depending on the needed height of pedals 111 for the user seated on the wheelchair 200. The height adjustment member 112 operationally connecting the electrical motor 102 to the pedals 111 helps the pedals to attain a cycling motion/movement when the user seated on the wheelchair 200 places his/her limbs on the pedals 111 and starts the simulator 100 for exercise. During the cycling movement of the pedals the angle of the position of the pedals 111 can vary in a horizontal and a vertical plane.

Figure 8:
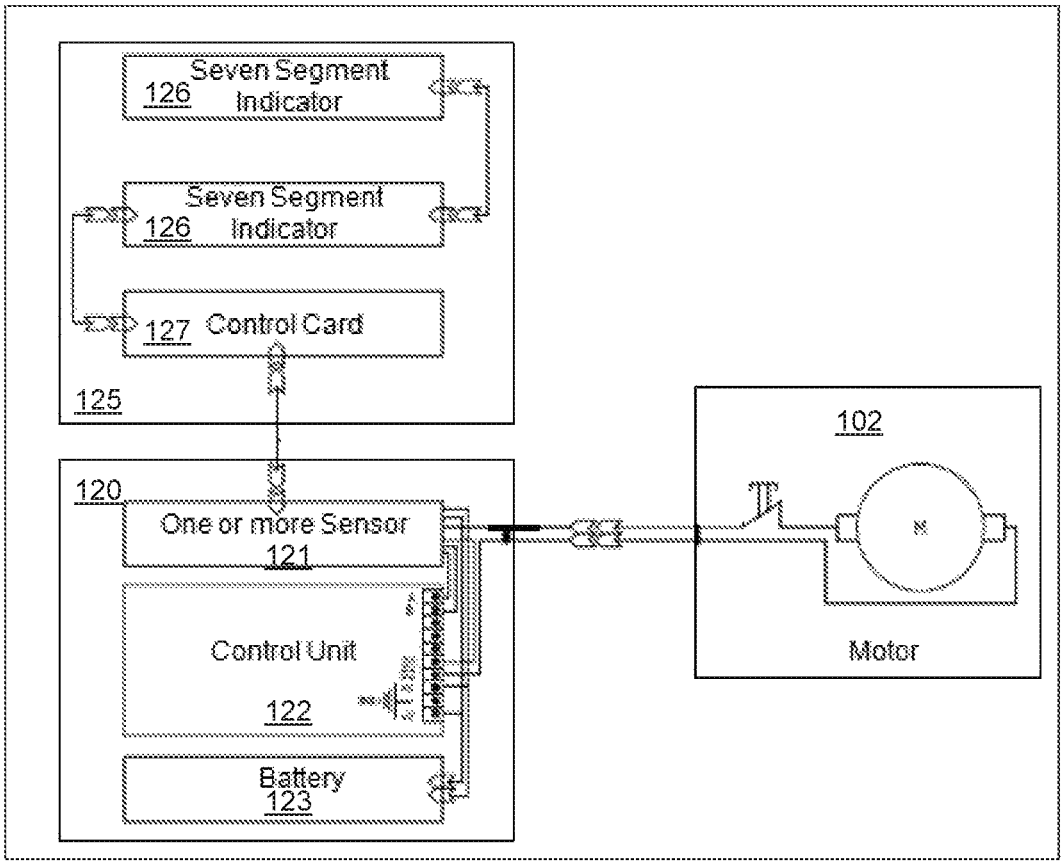
FIG. 8 illustrates an exemplary bock diagram which shows electrical connectivity between an electric drive unit, a housing embodying an electrical motor, and a user interface device.

As shown in FIG. 8, the simulator system 100 further includes an electric drive unit 120 configured to drive the electrical motor 102, thereby enabling pedals 111 operationally engaged to the shaft 103 of the motor 102 to rotate in a specified direction, may be in a clockwise and/or an anticlockwise direction.

The simulator system 100 further includes one or more user interface devices 125 to enable the user seated on the wheelchair 200 to at least view and selectively change one or more parameters associated with the motor 102, and the pedals 111. In an example, the parameters includes but not limited to speed and direction of the pedals 111, torque generated by the electrical motor 102, motor current, gear speed or gear change and so on. The one or more user interface devices 125 may be wired or wireless devices. As shown in accompanying figures, especially in the FIG. 6, the examples of wired devices include a monitor/display panel with two segment indicators 126, some navigating buttons provided for inputting or setting the parameters and viewing/monitoring information such as but not limited to a speed associated with the pair of pedals, quantity of calories burnt during a exercise session, a distance travelled by pedaling, changes in body weight of the user exercising, measure heart rate, metabolic equivalent related to the exercise performed, count simulation level, pulse rate and oxygen saturation level in the user. As further seen in the FIG. 8, the user interface device 125 is operationally coupled to the electric drive unit 120 using a control card 127. The electric drive unit 120 controls the display of the various parameters and information on the interface device 125, specifically on the seven segment indicators 126. It should be understood that for the purpose of this application, any other forms of display means may be used.

According to some other embodiment, the one or more user interface devices 125 may be wireless devices with integrated wireless communication module, such as for example a mobile phone as shown in FIG. 9. The user seated on the wheelchair 200 can use hi/her mobile phone loaded with a specific application to interface the phone with the simulator 100 such as to allow the user to input or set the parameters such as the speed and direction of the pedals, the motor current and so on, and monitor information such as but not limited to the speed associated with the pedals, the quantity of calories burnt during a exercise session, and the hypothetical distance travelled by pedaling, changes in body weight of the user exercising, measure heart rate, metabolic equivalent related to the exercise performed, count simulation level, pulse rate and oxygen saturation level in the user.

According to some other embodiments, the one or more user interface devices 125 may be provisioned for connecting to other communication devices, such as external PC, laptops and so on. For example, the user interface device 125 may be provided with one or more USB cables to enable the connection between the user interface device 125 and the external communication devices.

Further, the one or more user interface devices 125 may be equipped with wireless communication modules such as Bluetooth and the like to enable the user interface device 125 to connect to a server (not shown). Consider a hospital scenario, where the simulator system 100 is deployed for exercising the patients. There the simulator 100 may be mounted on the wheelchair 200 for the disabled user to exercise. The information and data that arrive at the user interface device 125 including but not limited to various parameters and other information may be sent to the server under the control of expert doctors located remotely from the location of the location of the simulator system 100 and the wheelchair 200.

The electric drive unit 120 is configured to drive the electrical motor 102, the pedals 111, and the user interface devices 125 via one or more power sources preferably batteries 123. The electric drive unit 120 further includes one or more sensors 121 configured to monitor the various parameters associated with the electrical motor 102, the pair of pedals 111. The sensors 121 may include but not limited to the pedal speed sensor, the motor current sensor, the voltage sensor and the torque sensor and the like. The parameters sensed or monitored by the sensors 121 include but not limited to the speed and direction of the pedals 111, the torque generated by the electrical motor 102, the motor current, the gear speed or gear change and so on.

The electric drive unit 120 further includes one or more power modulators (not shown) configured to control the supply of power to the electric motor 102. During the transient operations like starting, braking and speed, reversing, excessive current is drawn from one or more power sources (batteries) 123. The power modulator is configured to convert the energy according to the requirement of the motor 102.

The electric drive unit 120 further includes a control unit 122 or one or more controller operationally coupled to the user interface devices 125, the electrical motor 102, and the one more sensors 121 and the one or more power modulators. The control unit 122 is adapted to receive the one or more parameters associated with the electrical motor 102, the pair of pedals 111 from the one or more user interface devices 125, and the sensors 121. Further, the control unit 122 processes or analyzes the parameters received from the sensors 121, and the one or more user interface devices 125 to generate one or more corrective commands based on the analysis performed. The generation of the corrective commands upon analysis of the received parameters is based on comparative analysis of the received/monitored parameters with predefined set of values (preset values) stored in the control unit 122 or memory accessible by the control unit 122 for each of the received parameters associated with the electrical motor 102, the pedals 111. As the part of the corrective actions/commands, the control unit 122 of the electric drive unit 120 may change the speed of the pedals 111 and the force applied to the patient's limbs. Further, the control unit 122 may command to the power modulators for the protection of the electrical motor 102 by adjusting the power level supplied to the motor 102.

As shown in the FIG. 8, the one or more power sources 123 is electrically coupled to and adapted to power up the electrical motor 102, the sensors 121, the user interface devices 125, the power modulators, and the control unit 122. Typically, the one or more power sources 123 (Eg. batteries) are positioned below the seat 208 of the wheelchair 200. The battery 123 is electrically coupled to the control unit 122 and usually charged using an external power source.

The simulator system 100 of the present invention further includes one or more brakes enabling the user to lock the pair of pedals in a specific direction and position. According to the embodiment, the brake may be embodied as a part of the display of the user interface device 125. For example, when the user switches of the user interface device 125, the brake may be auto applied to stop cycling motion of the pedals 111 in any position by switching off the electric drive 122. According to some other embodiment, a physical brake 101*b* may be present in many different forms such as a pull or push button to apply brake in order to stop the movements on the pedals 111 as shown in the FIG. 7.

The simulator system 100 of the present invention further include one or more handles 127 configurable in an area in front of arm rests provided on the wheelchair 200 as shown configured in the FIGS. 1-2. As seen, the handles 127 are adapted to hold the user interface device 125 in a position so as to facilitate the user seated on the wheelchair 200 to view and change the one or more parameters associated with the electrical motor 102, and the pedals 111. The handles 127 may be mounted either on the both sides or one side of the wheelchair 200 using engagement members 127*a*. As shown in the FIG. 1, the user interface device 125, may either be mounted directly on the handle 127, or may be mounted on the handle 127 using additional stand, for example a tripod stand 126 as shown in the FIG. 2.

Figure 10:
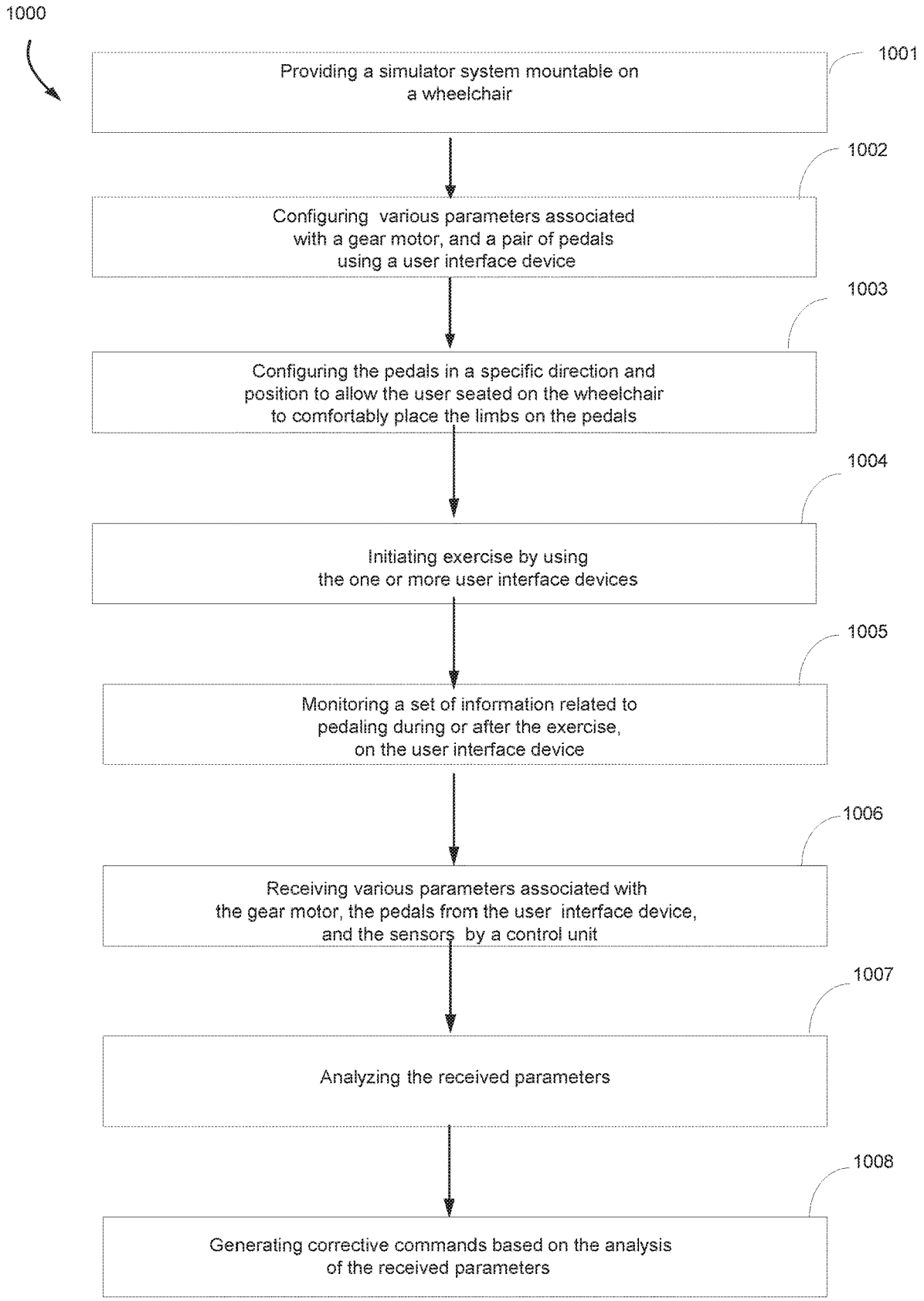
FIG. 10 illustrates a method for exercising lower limbs of the user seated on the wheelchair, according to an embodiment of the present invention.

Embodiments of the present invention further disclose a method 1000 for exercising lower limbs of a user seated on a wheelchair 200 which will now be described with respect to the FIG. 10 in conjunction to the FIGS. 1-8 described above. The method includes steps of providing a simulator system 100 mountable on the wheelchair 200 (step 1001). The simulator system 100 includes the housing 101 comprising of the gear motor 102, the pair of pedals 111, the electric drive unit 120, the one or more user interface devices 125, and the support assembly as described above with reference to the FIGS. 1-8.

The method for exercising the lower limbs of the user seated on the wheelchair 200 further includes a step of configuring the one or more parameters associated with the gear motor 102, and the pedals 111 using the user interface device 125 (step 1002). The various parameters include speed and direction of the pedals 111, torque generated by the gear motor 102, motor current, output power generated thereof, gear speed and so on.

The method for exercising the lower limbs of the user seated on the wheelchair 200 further includes a step of configuring or setting the pair of pedals 111 in a specific direction and position so as to allow the user seated on the wheelchair 200 to comfortably place their limbs on the pedals 111 (step 1003). The configuration of the pedals 111 in the specific direction and position is facilitated by adjustment of a tilt angle, and position of the housing 101 mounted over the elongated arm 107 of the support assembly using the rotating knobs 107*a*, and 108*a*.

The method for exercising the lower limbs of the user seated on the wheelchair 200 further includes a step of initiating exercise by using the user interface device 125 (step 1004) either by the user seated on the wheelchair 200 or a different user say a healthcare personnel. The user can set or configure one or more parameters associated with the motor 102 or the pedals 111 using the buttons or interface provided on the user interface device 125. Once the user sets the parameters, the user can initiate the exercise. The exercise may be taken up indoors or outdoors for any specific time length based on the user's health conditions or severity motor problem in the user's limbs.

The method for exercising the lower limbs of the user seated on the wheelchair 200 further includes a step of selectively monitoring a set of information related to pedaling during or after the exercise, on the user interface device 125 (step 1005). The set of information preferably includes but not limited to speed associated with the pair of pedals, quantity of calories burnt during a exercise session, a distance travelled by pedaling, changes in body weight of the user exercising, measure heart rate, metabolic equivalent related to the exercise performed, count simulation level, pulse rate and oxygen saturation level in the user.

The method for exercising the lower limbs of the user seated on the wheelchair 200 further includes a step of receiving the parameters associated with the gear motor 102, the pedals 111 from the user interface device 125, and the sensors 121 (step 1006).

The method for exercising the lower limbs of the user seated on the wheelchair 200 further includes a step of processing or analyzing the parameters received from the sensors 121 and the user interface device 125 (step 1007).

The method for exercising the lower limbs of the user seated on the wheelchair 200 further includes a step of generating one or more corrective commands based on the analysis of the parameters received from the sensors 121, and the user interface device 125 (step 1008). The generation of the corrective commands upon analysis of the received parameters is based on comparative analysis of the received/monitored parameters with predefined set of values (preset values) stored in the control unit 122 or associated memory for each of the corresponding received parameters associated with the electrical motor 102, the pedals 111. As the part of the corrective actions/commands, the control unit 122 of the electric drive unit 120 may change the speed of the pedals 111 and the force applied to the patient's limbs. Further, the control unit 122 may command to the one or more power modulators for the protection of the electrical motor by adjusting the power level supplied to the motor 102.

Besides the advantages outlined as objectives and as described in the forgoing description above, the simulator system 100 is preferably embodied as a single piece splash proof device made using different materials preferably metals and the like known in the art. The one-piece construction of the device provides convenience in terms of portability, storage and in terms of the outdoor and indoor uses. The simulator system of the present invention 100 is made to withstand a large temperature variation from −10° C. to +30° C. In another embodiment, the simulator system 100 facilitates adjustment of the amplitude of motion of the pedals 111 for the patients, specially the anthropometric patients. Further, the simulator allows movement of the user's limbs, while the user is seated in the wheelchair 126.

The foregoing description of the specific embodiments fully reveals the general nature of the embodiments herein that others can, by applying current knowledge, readily modify or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the embodiments as described herein.

What is claimed is:

1. A simulator system (100) removably mountable on a wheelchair for exercising lower limbs of a user seated thereon, the simulator system (100) comprising: a housing (101) comprising an electrical motor (102) with a first shaft (103) having a first end and a second end, wherein the first end and the second end of the first shaft horizontally extend out of the housing (101) through a pair of lateral faces (101*a*); a support assembly comprising: a pair of supporting members (104), each of the supporting members (104) comprising a first arm (104*a*) with a first slot, and a second arm (104*b*) with a second slot, wherein the first arm (104*a*) and the second arm (104*b*) are conjoint at a junction having a third slot; a first connecting arm (105) comprising a first end and a second end, wherein the first end and the second end of the first connecting arm (105) engages into the third slot present in each of the pair of supporting members (104); a second connecting arm (106) comprising a first end and a second end, wherein the first end and the second end of the second connecting arm (106) engages into the second slot present in each of the pair of supporting members (104); an elongated arm (107) with a proximal end and a distal end, the elongated arm (107) engages with the first connecting arm (105) at the distal end, and is adapted to support and slidably move the housing (101) mounted thereon along its longitudinal axis using a first rotating knob (107*a*) present near the proximal end; a second rotating knob (108*a*) mounted on a second shaft (108) connecting the second connecting arm (106) and a bracket (109) engaged to the first connecting arm (105), wherein the second rotating knob (108*a*) helps adjust a tilt angle of the housing (101) attached over the elongated arm (107) and provides stability to the support assembly when the simulator system (100) is mounted on the wheelchair (200); a pair of connecting members (110), each of the connecting members comprising a gripping assembly (110*b*)-(110*d*), and a vertical shaft (110*a*) mounted on the gripping assembly (110*b*)-(110*d*), wherein the vertical shaft (110*a*) of each of the pair of connecting members (110) engages into the first slot present in each of the pair of supporting members (104), and the gripping assembly (110*b*)-(110*d*) of each of the pair of connecting members (110) engages to a base frame (202) of the wheelchair (200) for removably mounting the simulator system (100) on the wheelchair (200); a pair of pedals (111), each of the pedals (111) connected to the first end and the second end of the first shaft (103) horizontally extending out of the housing (101) through the pair of lateral faces (101*a*); an electric drive unit (120) configured to drive the electrical motor (102), thereby enabling the pair of pedals (111) engaged to the first shaft (103) to rotate in a specified direction; and one or more user interface devices (125) to enable the user seated on the wheelchair (200) to at least view one or more parameters associated with the electrical motor (102) and the pair of pedals (111), and change the one or more parameters associated with the electrical motor (102), and the pair of pedals (111).

2. The simulator system (100) of claim 1, wherein the electrical motor (102) is a gear motor.

3. The simulator system (100) of claim 1, wherein the first connecting arm (105) is engaged to the pair of supporting members (104) by means of at least one a pair of nuts (105*a*), one or more washers, and one or more sleeves.

4. The simulator system (100) of claim 3, wherein the pair of nuts (105*a*) enables the simulator system (100) to be mounted on the wheelchair (200) of varied width.

5. The simulator system (100) of claim 1, wherein the first connecting arm (105) and the second connecting arm (106) engaging the pair of supporting members (104) are configured in parallel and in spaced relation to each other.

6. The simulator system (100) of claim 1, wherein the pair of supporting members (104) are configured parallel to each other.

7. The simulator system (100) of claim 1, wherein the first rotating knob (107*a*) is mounted at an end of a third shaft (107*b*) having a spring and housed within the elongated arm (107).

8. The simulator system (100) of claim 1, wherein the each of the pedals (111) is connected to the first end and the second end of the first shaft (103) by means of a height adjustment member (112) comprising a plurality of slots.

9. The simulator system (100) of claim 8, wherein height adjustment member (112) operationally connected to the electrical motor (102) helps the pair of pedals (111) to attain a cycling motion when the user seated on the wheelchair (200) places foot on the pair of pedals (111) and starts the simulator (100) for exercise.

10. The simulator system (100) of claim 1, wherein the electric drive unit (120) comprises: one or more sensors (121) configured to monitor the one or more parameters associated with the electrical motor (102) or the pair of pedals (111); one or more power modulators configured to control the supply of power to the electric motor (102); a control unit (122) operationally coupled to the one or more user interface devices (125), the electrical motor (102), or the one more sensors (121), wherein the control unit (122) is adapted to perform at least one of: a) receive the one or more parameters associated with the electrical motor (102) or the pair of pedals (111) from the one or more user interface devices (125) and the one or more sensors (121), b) analyze the one or more parameters received from the one more sensors (121) and the one or more user interface devices (125), and c) generate one or more corrective commands based on the analysis of the one or more parameters received from the one more sensors (121) and the one or more user interface devices (125); and one or more power sources (123) electrically coupled to and adapted to power at least one of: a) the electrical motor (102), b) the one or more sensors (121), c) the one or more user interface devices (125), d) the one or more power modulators, and e) the control unit (122).

11. The simulator system (100) of claim 1, wherein the one or more parameters includes at least one of: speed and direction of the pair of pedals (111), torque generated by the electrical motor (102), motor current, gear speed, or gear change.

12. The simulator system (100) of claim 10 wherein generation of the one or more corrective commands upon analysis of the one or more parameters received from the one more sensors (121) and the one or more user interface devices (125) is based on predefined values for each of the parameters associated with the electrical motor (102), the pair of pedals (111).

13. The simulator system (100) of claim 1 further comprising one or more brakes (101*b*) enabling the user to lock the pair of pedals (111) in a specific direction and position.

14. The simulator system (100) of claim 1 further comprising one or more handles (127) configurable in an area in front of arm rests provided on the wheelchair (200), wherein the one or more handles (127) are adapted to hold the one or more user interface devices (125) in a position so as to facilitate the user seated on the wheelchair (200) to view and change the one or more parameters associated with the electrical motor (102) and the pair of pedals (111).

15. A method for exercising lower limbs of a user seated on a wheelchair (200), the method comprising the steps of: providing, a simulator system (100) mountable on the wheelchair (200), wherein the simulator system (100) comprises a housing (101) comprising an electrical gear motor (102) with a first shaft (103) having a first end and a second end, wherein the first end and the second end of the first shaft horizontally extend out of the housing (101) through a pair of lateral faces (101*a*); a pair of pedals (111), each of the pedals (111) connected to the first end and the second end of the first shaft (103) horizontally extending out of the housing (101) through the pair of lateral faces (101*a*); an electric drive unit (120) configured to drive the electrical motor (102), thereby enabling the pair of pedals (111) engaged to the first shaft (103) to rotate in a specified direction; one or more user interface devices (125) to enable the user seated on the wheelchair (200) to at least view one or more parameters associated with the gear motor (102), and the pair of pedals (111), and change the one or more parameters associated with the electrical motor (102), and the pair of pedals (111); and a support assembly configured for removably mounting the simulator system (100) on the wheelchair (200); configuring the one or more parameters associated with the gear motor (102), and the pair of pedals (111) using the one or more user interface devices (125); configuring, the pair of pedals (111) in a specific direction and position so as to allow the user seated on the wheelchair (200) to comfortably place the limbs on the pair of pedals (111), wherein the step of configuring the pair of pedals (111) in a specific direction and position is facilitated by adjusting a tilt angle and position of the housing (101) mounted over an elongated arm (107) of the support assembly; initiating, exercise by using the one or more user interface devices (125); monitoring, a set of information related to pedaling during or after the exercise, on the one or more user interface devices (125); and providing a control unit (122) connected with the electric drive unit (120), and operationally coupled to the one or more user interface devices (125), the gear motor (102), and one more sensors (121), wherein the control unit (122) performing at least one of: a) receiving the one or more parameters associated with the gear motor (102) or the pair of pedals (111) from the one or more user interface devices (125) and the one or more sensors (121), and b) analyzing the one or more parameters received from the one or more sensors (121) and the one or more user interface devices (125); and generating, one or more corrective commands based on the analysis of the one or more parameters received from the one more sensors (121), and the one or more user interface devices (125).

16. The method of claim 15, wherein the support assembly comprises: a pair of supporting members (104), each of the supporting members (104) comprising a first arm (104*a*) with a first slot, and a second arm (104*b*) with a second slot, wherein the first arm (104*a*) and the second arm (104*b*) are conjoint at a junction having a third slot; a first connecting arm (105) comprising a first end and a second end, wherein the first end and the second end of the first connecting arm (105) engages into the third slot present in each of the pair of supporting members (104); a second connecting arm (106) comprising a first end and a second end, wherein the first end and the second end of the second connecting arm (106) engages into the second slot present in each of the pair of supporting members (104); an elongated arm (107) with a proximal end and a distal end, the elongated arm (107) engages to the first connecting arm (105) at the distal end, and is adapted to support and slidably move the housing (101) mounted thereon along its longitudinal axis using a first rotating knob (107*a*) present near the proximal end; a second rotating knob (108*a*) mounted on a second shaft (108) connecting the second connecting arm (106) and a bracket (109) engaged to the first connecting arm (105), wherein the second rotating knob (108*a*) helps adjust a tilt angle of the housing (101) attached over the elongated arm (107), and provide stability to the support assembly, when the simulator system (100) is mounted on the wheelchair (200); and a pair of connecting members (110), each of the connecting members comprising a gripping assembly (110*b*)-(110*d*), and a vertical shaft (110*a*) mounted on the gripping assembly (110*b*)-(110*d*), wherein the vertical shaft (110*a*) of each of the pair of connecting members (110) engages into the first slot present in each of the pair of supporting members (104), and the gripping assembly (110*b*)-(110*d*) of each of the pair of connecting members (110) engages to a base frame (202) of the wheelchair (200) for removably mounting the simulator system (100) on the wheelchair (200).

17. The method of claim 15, wherein the one or more parameters includes at least one of: speed and direction of the pair of pedals (111), torque generated by the electrical motor (102), motor current, output power, gear speed, or gear change.

18. The method of claim 15, wherein the set of information is comprised of at least one of: a speed associated with the pair of pedals (111), quantity of calories burnt during an exercise session, a distance travelled by pedaling, changes in body weight of the user exercising, heart rate, metabolic equivalent related to the exercise performed, count simulation level, pulse rate, and oxygen saturation level in the user.

19. The method of claim 15, wherein generation of the one or more corrective commands upon analysis of the one or more parameters received from the one more sensors (121) and the one or more user interface devices (125) is based on predefined values for each of the parameters associated with the electrical motor (102) or the pair of pedals (111).

20. The method of claim 15, wherein the electric drive unit (120) further comprising: one or more power modulators configured to control the supply of power to the electric motor (102); and one or more power sources (123) electrically coupled to and adapted to power up at least one of: the electrical motor (102), the one or more sensors (121), the one or more user interface devices (125), the one or more power modulators, and the control unit (122).

* * * * *